US008854165B2

(12) United States Patent
Irwin

(10) Patent No.: US 8,854,165 B2
(45) Date of Patent: Oct. 7, 2014

(54) SOFT LATCH BIDIRECTIONAL QUIET SOLENOID

(71) Applicant: Saia-Burgess, Inc., Vandalia, OH (US)

(72) Inventor: James C. Irwin, Beavercreek, OH (US)

(73) Assignee: Saia-Burgess, Inc., Vandalia, OH (US)

( * ) Notice: Subject to any disclaimer, the term of this patent is extended or adjusted under 35 U.S.C. 154(b) by 0 days.

(21) Appl. No.: 13/865,338

(22) Filed: Apr. 18, 2013

(65) Prior Publication Data

US 2013/0307652 A1 Nov. 21, 2013

Related U.S. Application Data

(62) Division of application No. 12/130,941, filed on May 30, 2008, now Pat. No. 8,432,242.

(60) Provisional application No. 60/924,752, filed on May 30, 2007.

(51) Int. Cl.

| | |
|---|---|
| ***H01F 7/00*** | (2006.01) |
| ***H01F 7/08*** | (2006.01) |
| ***H01F 7/122*** | (2006.01) |
| ***H01F 7/16*** | (2006.01) |

(52) U.S. Cl.

CPC ..... *H01F 7/122* (2013.01); *H01F 7/1615* (2013.01); *H01F 2007/1669* (2013.01); *H01F 2007/1692* (2013.01)

USPC ..... 335/229; 335/220

(58) Field of Classification Search

USPC ..... 335/220–229, 253–255, 280, 281; 251/129.1

See application file for complete search history.

(56) References Cited

U.S. PATENT DOCUMENTS

| | | | | |
|---|---|---|---|---|
| 3,157,831 | A | | 11/1964 | Ray |
| 3,859,547 | A | | 1/1975 | Massie |
| 4,065,096 | A | * | 12/1977 | Frantz et al. ..... 251/129.1 |
| 4,078,709 | A | | 3/1978 | Jenkins |

(Continued)

FOREIGN PATENT DOCUMENTS

| | | |
|---|---|---|
| DE | 41 24 087 A1 | 1/1993 |
| DE | 44 00 433 A1 | 7/1995 |

(Continued)

OTHER PUBLICATIONS

U.S. Appl. No. 12/109,476, filed Apr. 25, 2008, entitled "Adjustable Mid Air Gap Magnetic Latching Solenoid".

(Continued)

*Primary Examiner* — Bernard Rojas
(74) *Attorney, Agent, or Firm* — Nixon & Vanderhye, P.C.

(57) ABSTRACT

Embodiments of soft latching solenoids comprise a coil assembly (24); a plunger assembly (26); at least one flux conductor (28) comprising a flux circuit. The coil assembly (24) is fixedly situated with respect to a solenoid frame (21). The plunger assembly (26) is configured to linearly translate in a first direction along a plunger axis (32) upon application of a pulse of power to the coil assembly (24). The flux conductor(s) (28) is/are positioned radially exteriorly to the plunger assembly (26) to form the flux circuit. The flux circuit comprises the solenoid frame (21), the plunger assembly (26), and the at least one flux conductor (28). The flux circuit is arranged and configured so that the plunger assembly (26) is held in a plunger detent position upon cessation of the pulse of power.

19 Claims, 9 Drawing Sheets

(56) References Cited

U.S. PATENT DOCUMENTS

| | | | | |
|---|---|---|---|---|
| 4,812,884 | A | 3/1989 | Mohler | |
| 5,138,291 | A | 8/1992 | Day | |
| 5,170,144 | A | 12/1992 | Nielsen | |
| 5,239,277 | A | 8/1993 | Vielot | |
| 5,453,724 | A | 9/1995 | Seymour et al. | |
| 5,470,043 | A | 11/1995 | Marts et al. | |
| 6,229,421 | B1 | 5/2001 | Floyd et al. | |
| 6,512,435 | B2 | 1/2003 | Van Namen | |
| 6,791,442 | B1 | 9/2004 | Schmidt | |
| 7,053,742 | B2 | 5/2006 | Lanni et al. | |
| 7,280,019 | B2 | 10/2007 | Koib et al. | |
| 2002/0093408 | A1 * | 7/2002 | Morita et al. | 335/220 |
| 2004/0055583 | A1 * | 3/2004 | Everingham | 123/520 |
| 2006/0061442 | A1 | 3/2006 | Brooks | |

FOREIGN PATENT DOCUMENTS

| | | | |
|---|---|---|---|
| DE | 100 38 575 | A1 | 2/2002 |
| EP | 0 465 120 | A1 | 1/1992 |
| FR | 2 612 276 | A1 | 9/1988 |
| JP | 2003-174759 | A | 6/2003 |
| WO | 2004/064084 | A2 | 7/2004 |
| WO | 2007/034195 | A1 | 3/2007 |

OTHER PUBLICATIONS

International Search Report and Written Opinion mailed Aug. 8, 2008 in PCT application PCT/US08/05328.

International Search Report and Written Opinion mailed Aug. 8, 2008 in PCT application PCT/US2008/065426.

International Preliminary Report on Patentability mailed Dec. 30, 2009 in PCT Application PCT/US2008/065426.

U.S. Office Action mailed Jun. 23, 2010 in related U.S. Appl. No. 12/109,476.

Supplementary European Search Report and Examination Report mailed May 8, 2012 in EP application 08756574.3.

* cited by examiner

SOFT LATCH BIDIRECTIONAL QUIET SOLENOID

This application is a divisional application of U.S. patent application Ser. No. 12/130,941 filed May 30, 2008, entitled "SOFT LATCH BIDIRECTIONAL QUIET SOLENOID", which claims priority and benefit of U.S. Provisional Patent Application 60/924,752, filed May 30, 2007, entitled "SOFT LATCH BIDIRECTIONAL QUIET SOLENOID"; both of which are incorporated herein by reference in their entirety.

BACKGROUND

I. Technical Field

This invention pertains to the field of solenoids, and particularly to solenoids which operate substantially without audible sound.

II. Related Art and Other Considerations

Most conventional solenoids have two ferromagnetic (e.g., steel or iron) pole pieces, one of which is a moveable pole piece which is attracted to the other (stationary) pole piece upon energization of the solenoid. The moveable pole piece usually comprises or is connected to or integral with a plunger or piston. The moveable piston or plunger, which can be in the form of an output shaft, is the serving or working element/aspect of the solenoid that can be employed in any of various applications or utilizations. See, for example, U.S. Pat. No. 4,812,884 to Mohler, entitled "Three-Dimensional Double Air Gap High Speed Solenoid", incorporated herein by reference.

Energization of the solenoid is accomplished by applying electrical current to an electromagnetically inductive coil that defines (at least partially) a volume wherein the pole pieces reside. For example, when the coil is energized the two metallic pole pieces can be attracted to one another. The attraction causes an impact of the two pole pieces at the end of travel of the moveable pole piece. Since the two pole pieces are metallic, the impact is noisy. In some applications or environments audible operation of a solenoid is a distraction or worse.

There are also common versions of conventional solenoids which have magnetic latching capability, typically through the use of a magnet in proximity to a pole piece (either in-line or coaxial). See, for example, U.S. patent application Ser. No. 12/109,476, filed Apr. 25, 2008, entitled "ADJUSTABLE MID AIR GAP MAGNETIC LATCHING SOLENOID", which is incorporated herein by reference.

Some solenoid models attempt to achieve quiet operation by not having metallic pole pieces arranged in-line. In other words, there are no pole pieces arranged to strike or contact each other. For example, a type of solenoid sometimes referred to as a "door bell" solenoid has a coil of wire, wound on a bobbin, with the inner diameter of the coil being the bearing for the plunger. The plunger is essentially a piece of steel. When power is applied to the coil, the plunger is accelerated into the coil. The solenoid frame itself has no stop or base, so that the plunger over travels and hits a ringer, and afterwards bounces back to allow a tone to resonate.

What is needed, and an object of the present invention, are one or more embodiments of solenoids that not only are quiet in plunger operation, but also maintain plunger position after activation without requiring continued application of power.

BRIEF SUMMARY

Embodiments of soft latching solenoids comprise a coil assembly; a plunger assembly; at least one flux conductor comprising a flux circuit. The coil assembly is fixedly situated with respect to a solenoid frame. The plunger assembly is configured to linearly translate in a first direction along a plunger axis upon application of a pulse of power to the coil assembly. The flux conductor is positioned radially exteriorly to the plunger assembly to form a flux circuit. The flux circuit comprises the solenoid frame, the plunger assembly, and the at least one flux conductor. The flux circuit is arranged and configured so that the plunger assembly is held in a plunger detent position upon cessation of the pulse of power.

Advantageously, elements comprising ferromagnetic material (plunger ferromagnetic portion(s) and the flux conductor) which experience translation relative to one another during linear translation of the plunger are arranged and configured so as not to make contact with one another even upon cessation of the linear translation of the plunger.

The embodiments also have bidirectional capability in that the plunger assembly can also linearly translate in a second direction along the plunger axis upon application of a second pulse of power to the coil assembly, the second direction being opposite the first direction.

In some example embodiments of solenoids the plunger assembly comprises one or more magnets. For example, in some example embodiments the solenoid comprises a solenoid frame; a coil assembly; a plunger assembly comprising one magnet; and plural flux conductors. The coil assembly is fixedly situated with respect to the solenoid frame. The plunger assembly is configured to linearly translate along a plunger axis upon application of a pulse of power to the coil assembly, with the plunger assembly comprising a plunger magnet. The plural flux conductors are spaced radially from the plunger assembly. The plural flux conductors comprise a first flux conductor situated in a first axial position relative to the solenoid frame and a second flux conductor situated in a second axial position relative to the solenoid frame. The plural flux conductors and the plunger assembly are arranged and configured so that the plunger assembly is held in a plunger detent position upon cessation of the pulse of power.

In the one magnet-in-plunger embodiments, the first flux conductor is situated so that, when a ferromagnetic end of the plunger is aligned with the first flux conductor in the plunger first detent position, no net axial force is applied to the plunger assembly due to the first flux conductor. The second axial position for the second flux conductor is located relative to the first axial position so that, when the plunger assembly is in the plunger first detent position, the plunger magnet and the second flux conductor electromagnetically maintain axial alignment.

In an example implementation, the plunger assembly comprises a plunger first ferromagnetic member; a plunger second ferromagnetic member; with the plunger magnet aligned axially between the plunger first ferromagnetic member and the plunger second ferromagnetic member.

In an example implementation, the plunger assembly comprises a plunger shank configured to extend beyond the second axial position relative to the solenoid frame when the plunger assembly has moved in a first translation direction to the plunger first detent position. The plunger shank carries a plunger stop member configured to limit an extent of travel of the plunger assembly in a second translation direction opposite to the first translation direction. The solenoid frame comprises an acoustic dampening member situated to muffle impact of the plunger stop member with the solenoid frame when the plunger assembly has reached its limit of travel in the second translation direction.

In an example implementation, with respect to the plunger axis, the ferromagnetic edges of the plunger magnet are equidistant from respective ferromagnetic edges of the second flux conductor when the plunger assembly is held in the plunger first detent position. An extent of the plunger magnet along the plunger axis and an extent of the second flux conductor in a direction parallel to the plunger axis are chosen to provide a predetermined holding force to maintain the plunger assembly in the plunger first detent position.

An example implementation further comprises a third flux conductor situated in a third axial position relative to the solenoid frame, and wherein with respect to the plunger axis the second flux conductor is intermediate the first flux conductor and the third flux conductor.

In an example implementation, the plural flux conductors are spaced radially from the plunger assembly by respective air gaps.

In an example implementation, the coil assembly comprises a first coil and a second coil. A pulse of power which causes electrical current to flow in a first direction in the first coil results in a force for translating the plunger assembly in a first translation direction toward the plunger first detent position. A pulse of power which causes electrical current to flow in a second direction in the second coil results in a force for translating the plunger assembly in a second translation direction away from the plunger first detent position.

In one example implementation of a two-coil assembly, the first coil and the second coil are concentrically radially arranged with respect to the plunger axis.

In another example implementation of a two-coil assembly, the first coil and the second coil are aligned in a direction parallel to the plunger axis. In such implementation, the second flux conductor can be positioned between the first coil and the second coil with respect to a direction that is parallel to the plunger axis.

In another example implementation of a two-coil assembly, the solenoid frame is oriented whereby gravitational force also attracts the plunger assembly for translating the plunger assembly in the second translation direction away from the plunger first detent position. In view of being supplemented with gravitational force, the second coil is configured to generate less force on the plunger assembly than the first coil.

Other example implementations the coil assembly can comprise a single coil. In such implementations, a pulse of power which causes electrical current to flow in a first direction in the single coil results in a force for translating the plunger assembly in a first translation direction toward the plunger first detent position; and wherein a pulse of power which causes electrical current to flow in a second direction in the single coil results in a force for translating the plunger assembly in a second translation direction away from the plunger first detent position.

Various configurations can be provided for the solenoid frame. In one example implementation the solenoid frame comprises a bobbin to which the coil assembly is exteriorly mounted, and wherein the bobbin at least partially defines a plunger cavity wherein the plunger assembly translates. In another example implementation the solenoid frame comprises (.e.g., in addition to the bobbin) a solenoid case having an essentially hollow cylindrical shape to at least partially define a coil cavity, with the coil assembly being situated in the coil cavity and configured at least partially to define a plunger cavity. In yet another example implementation, the solenoid frame comprises a substantially S-shaped member comprising a first frame segment situated substantially on a first side of the plunger axis and a second frame segment situated substantially on a second side of the plunger axis.

In some example embodiments of solenoids the plunger assembly comprises one magnet. In such embodiments further the at least one flux conductor comprises plural flux conductors, including a first flux conductor situated in a first axial position relative to the solenoid frame and a second flux conductor situated in a second axial position relative to the solenoid frame. The plural flux conductors and the plunger assembly are arranged and configured so that the plunger assembly is held in a plunger detent position upon cessation of the pulse of power. The first flux conductor is situated whereby, when a ferromagnetic end of the plunger is aligned with the first flux conductor in the plunger first detent position, no net axial force is applied to the plunger assembly due to the first flux conductor. The second axial position for the second flux conductor is located relative to the first axial position whereby, when the plunger assembly is in the plunger first detent position, the plunger magnet and the second flux conductor electromagnetically maintain axial alignment.

In yet other example embodiments, the at least one flux conductor comprises a magnet which is not located in the plunger assembly, e.g., the at least one flux conductor comprises a magnet positioned radially exteriorly to the plunger assembly and at least one non-magnet flux conductor positioned radially exteriorly to the plunger assembly. In one example implementation of the out-of-plunger magnet embodiment, one magnet is provided radially exteriorly to the plunger assembly and portions of the plunger assembly comprised of ferromagnetic material are non-uniform in radius to facilitate holding of the plunger assembly in the plunger detent position upon cessation of the pulse of power. In another example implementation, the at least one flux conductor comprises two magnets positioned radially exteriorly to the plunger assembly at respective two ends of the solenoid frame and the non-magnet flux conductor is positioned between the two magnets with respect to a direction parallel to an axis of the plunger assembly.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other embodiments that depart from these specific details. That is, those skilled in the art will be able to devise various arrangements which, although not explicitly described or shown herein, embody the principles of the invention and are included within its spirit and scope. In some instances, detailed descriptions of well-known devices, circuits, and methods are omitted so as not to obscure the description of the present invention with unnecessary detail. All statements herein reciting principles, aspects, and embodiments of the invention, as well as specific examples thereof, are intended to encompass both structural and functional equivalents thereof Additionally, it is intended that such equivalents include both currently known equivalents as well as equivalents developed in the future, i.e., any elements developed that perform the same function, regardless of structure.

Figure 1:
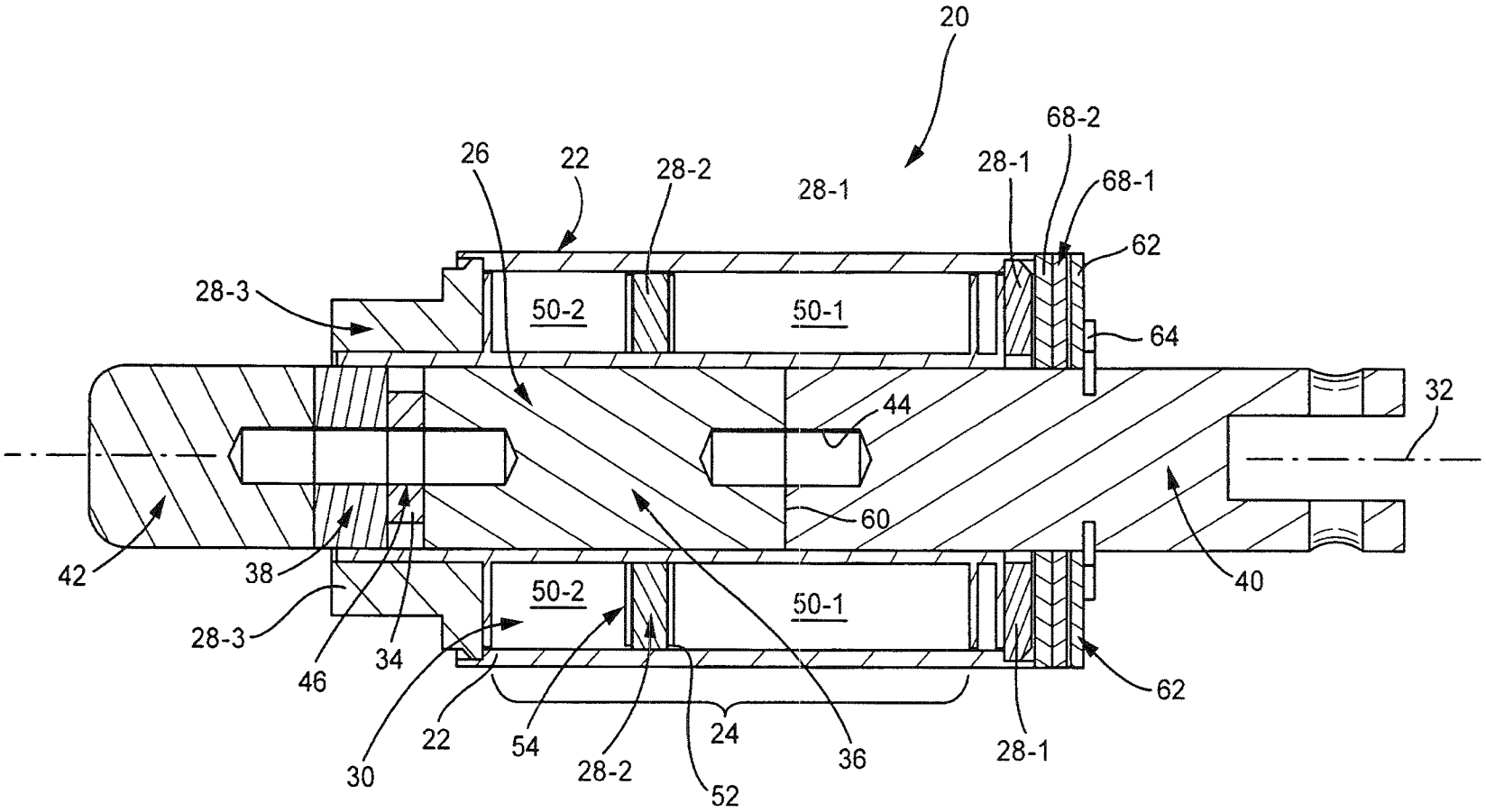
FIG. 1 is a cross sectioned view of a solenoid according to a first example embodiment, showing the solenoid in a plunger-retracted position.
Figure 2:
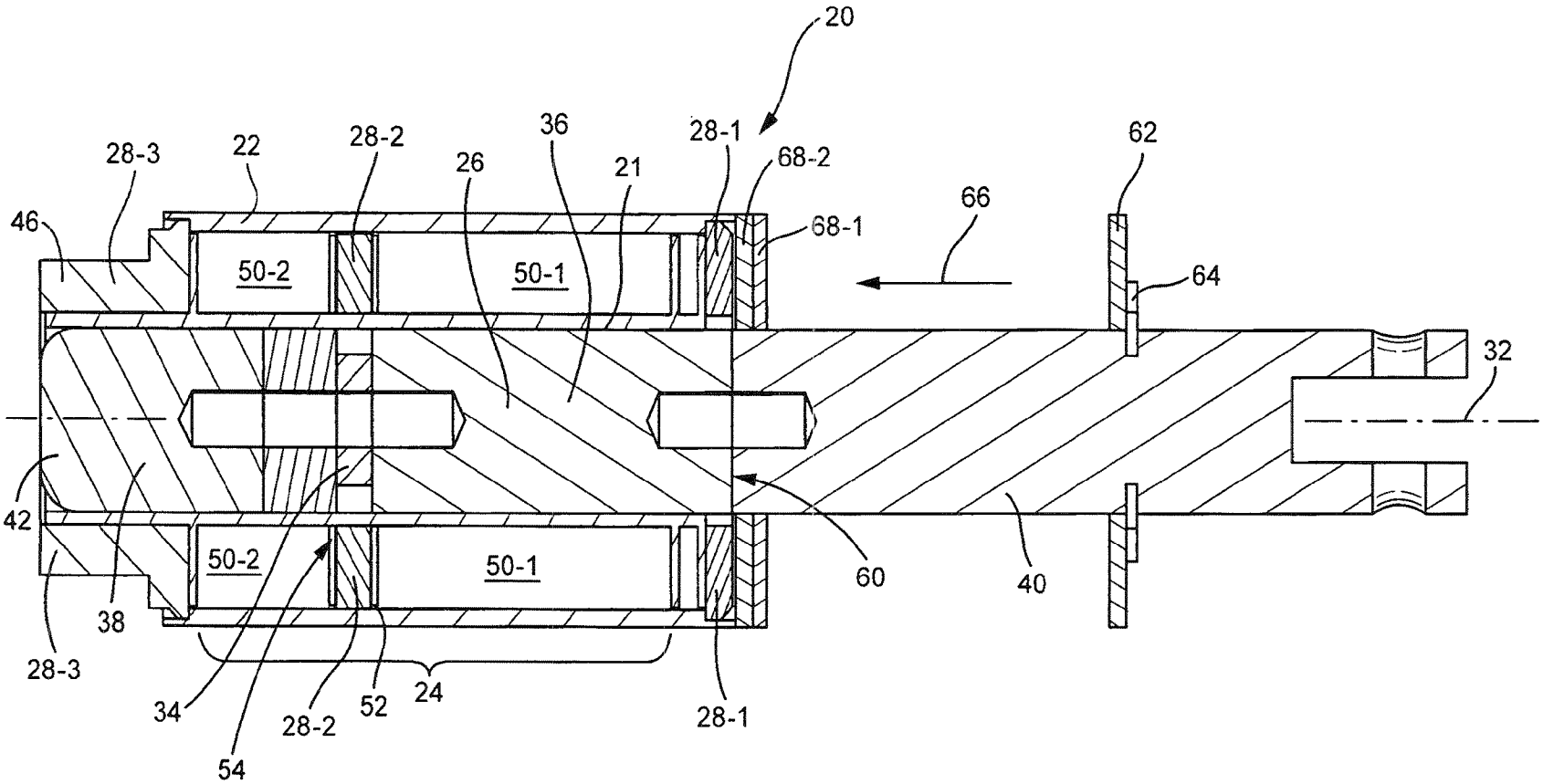
FIG. 2 is a cross sectioned view of the solenoid of FIG. 1, showing the solenoid in a plunger-extended position.
Figure 3:
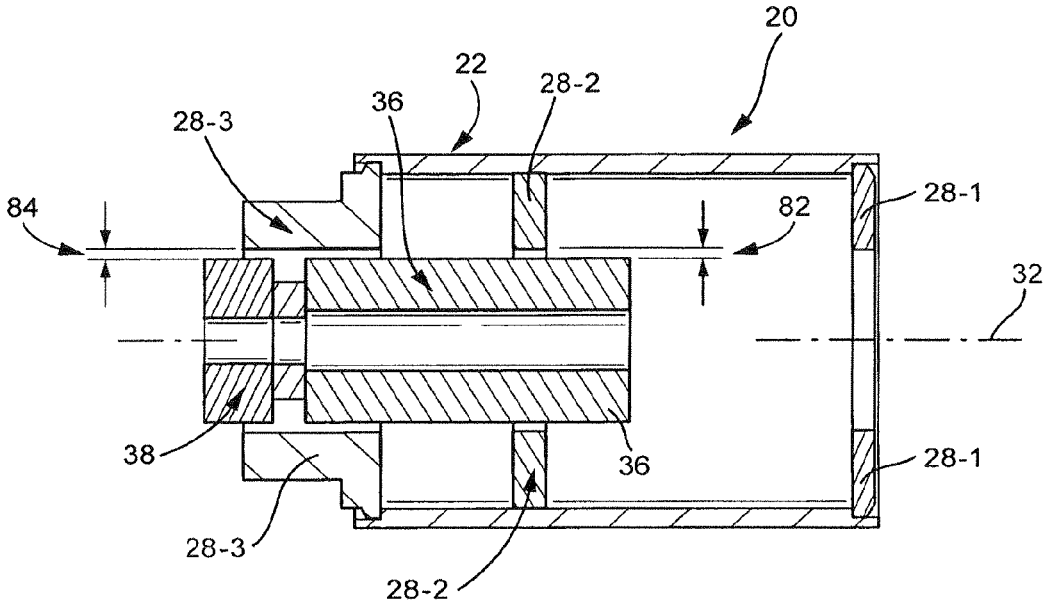
FIG. 3 is a cross sectioned view of example ferromagnetic components of the solenoid of FIG. 1 in the plunger-retracted position.
Figure 4:
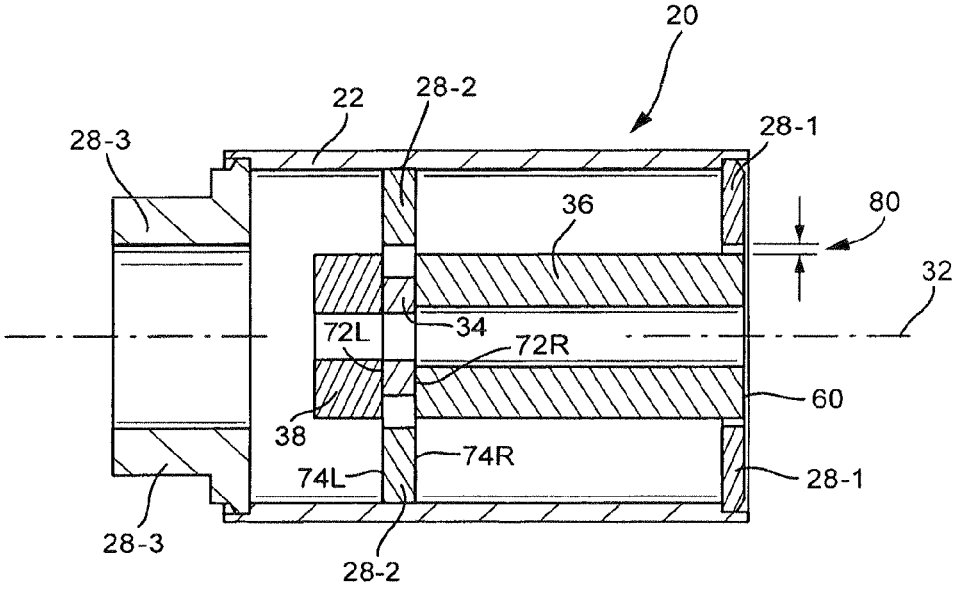
FIG. 4 is a cross sectioned view of example ferromagnetic components of the solenoid of FIG. 1 in the plunger-extended position.
Figure 5:
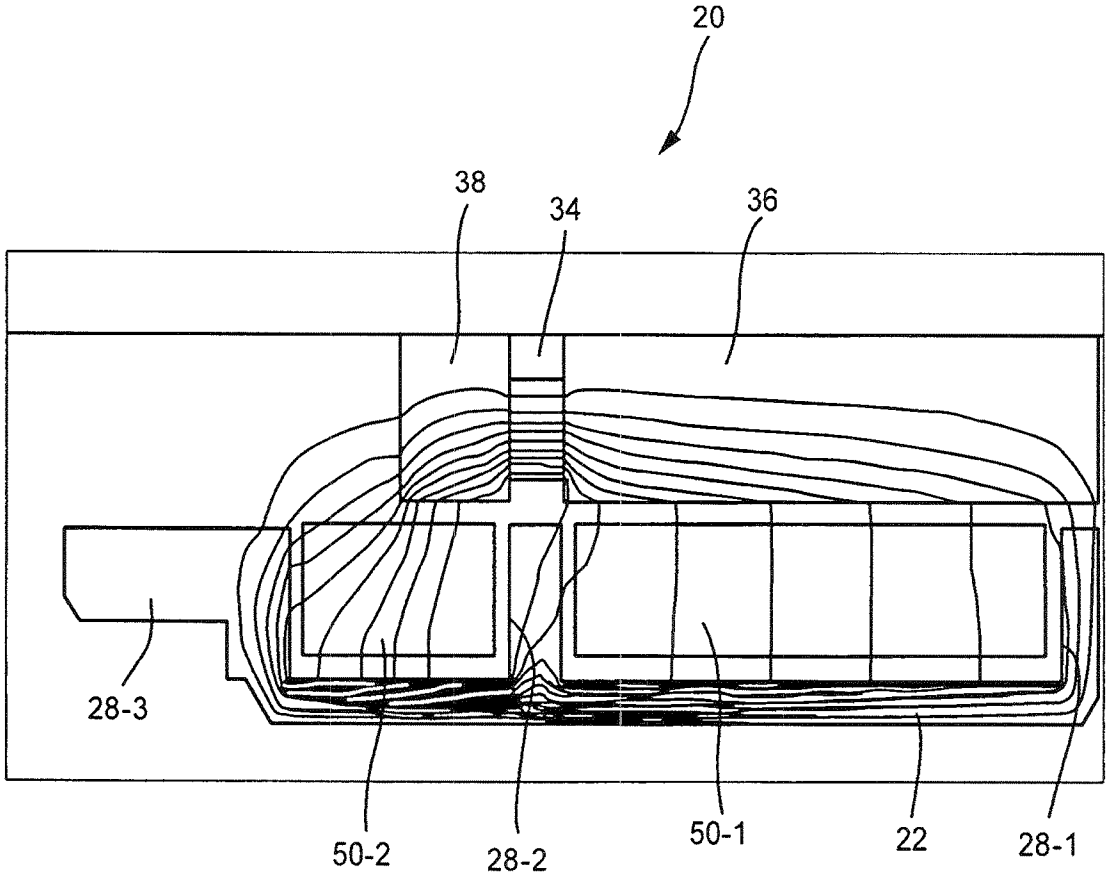
FIG. 5 is a cross-sectioned view of the example ferromagnetic components of the solenoid of FIG. 1, showing lines of flux when the solenoid is in the plunger-extended position.

FIG. 1 through FIG. 5 pertain to a first example embodiment of a solenoid, e.g., a magnet-in-plunger solenoid 20. Each of FIG. 1 through FIG. 5 show cross sectioned structure of solenoid 20. FIG. 1 particularly shows solenoid 20 in a plunger-retracted position, whereas FIG. 2 shows solenoid 20 in a plunger-extended position or plunger detent position. FIG. 3 shows example ferromagnetic components of the solenoid of FIG. 1 in the plunger-retracted position; FIG. 4 shows the same example ferromagnetic components of solenoid 20 in the plunger detent position. FIG. 5 showing lines of flux relative to selected components of solenoid 20 when in the plunger-extended position.

The solenoid 20 of the first example embodiment comprises solenoid frame 21; coil assembly 24; plunger assembly 26; and plural flux conductors 28 (e.g., flux conductors 28-1, 28-2, and 28-3). As understood subsequently with reference to other example embodiments, the solenoid frame 21 can be of various shapes and configurations. In the example embodiment of FIG. 1-FIG. 5, solenoid frame 21 comprises a bobbin which has an essentially hollow cylindrical shape. Since (at least the embodiment of FIG. 1-FIG. 5) the bobbin is a primary element comprising the frame, the terms "frame", "bobbin", and "stator" are used interchangeably and denoted by reference numeral 21.

The coil assembly 24 is fixedly situated with respect to solenoid frame 21, and in this particular example embodiment is situated in an annular coil space 30 which is defined by solenoid frame 21. In particular, the coil(s) of coil assembly 24 are wound about a circumferential surface(s) of the bobbin of solenoid frame 21. The volume within solenoid frame 21 occupied by coil assembly 24 in turn defines a plunger cavity which is essentially concentric to solenoid frame 21 and coil assembly 24.

Plunger assembly 26 is situated in the plunger cavity and is configured to linearly translate along a plunger axis 32 upon application of a pulse of power to the coil assembly 24. In the example embodiment of FIG. 1 through FIG. 5, plunger assembly 26 comprises plunger magnet 34; plunger first ferromagnetic member 36; plunger second ferromagnetic member 38; plunger shank 40; and plunger nose member 42. Each of plunger shank 40; plunger first ferromagnetic member 36; plunger magnet 34; plunger second ferromagnetic member 38; and plunger nose member 42 are aligned along plunger axis 32, and in the order just mentioned from right to left. Plunger first dowel 44 joins plunger shank 40 to plunger first ferromagnetic member 36; plunger second dowel 46 extends axially through each of plunger first ferromagnetic member 36, plunger magnet 34, plunger second ferromagnetic member 38, and plunger nose member 42. Thus, plunger magnet 34 is aligned axially between plunger first ferromagnetic member 36 and plunger second ferromagnetic member 38. The plunger shank 40 and plunger nose member 42 comprise a non-ferromagnetic material, such as aluminum, for example.

The plural flux conductors 28 are spaced radially from plunger assembly 26, and in the example embodiment of FIG. 1-FIG. 5 share coil space 30 with coil assembly 24. In the example embodiment of FIG. 1-FIG. 5, plural flux conductors 28 comprise first flux conductor 28-1 situated in a first axial position relative to solenoid frame 21; second flux conductor 28-2 situated in a second axial position relative to solenoid frame 21; and third flux conductor 28-3 situated in a third axial position relative to solenoid frame 22. Each of the plural flux conductors 28-1 and 28-2 are essentially ring-shaped or annular. Third flux conductor 28-3 is also ringed-shaped or annular, and also has an axially-extending neck 46. The first flux conductor 28-1 is situated at the first axial position which is proximate a first axial end (e.g., shank end) of solenoid frame 21. The third flux conductor 28-3 is situated in a third axial position relative to the solenoid frame, e.g., at a second axial end of solenoid frame 21. With respect to the plunger axis 32, the second flux conductor 28-2 is intermediate the first flux conductor 28-1 and the third flux conductor 28-3.

In the example embodiment of FIG. 1-FIG. 5, coil assembly 24 comprises two coils: first coil 50-1 and second coil 50-2. Both first coil 50-1 and second coil 50-2 reside in the coil space 30 radially concentrically between frame case 22 and plunger assembly 26. In an axial sense, first coil 50-1 and second coil 50-2 are spaced apart, with three elements situated there between: insulator ring 52; second flux conductor 28-2; and insulator ring 54. The second flux conductor 28-2 is thus situated at the second axial position relative to solenoid frame 21, the second axial position being intermediate the first axial position (at which first flux conductor 28-1 resides) and the second axial end of solenoid frame 21. The exact placement of second flux conductor 28-2 at the second axial position depends on the relative axial extents of the first coil 50-1 and the second coil 50-2.

As hereinafter explained, the plunger assembly 26 is operated to translate either in a first direction (to the right in FIG. 1) to a plunger detent position (e.g. plunger extended position) whereat the plunger assembly 26 becomes latched or in a second direction (to the left in FIG. 2) to the plunger-retracted position, depending upon whether first coil 50-1 or second coil 50-2 is energized by a pulse of power. The plural flux conductors (particularly first flux conductor 28-1 and second flux conductor 28-2) and plunger assembly 26 are arranged and configured so that, when extended, the plunger assembly 26 is held in the plunger detent position (e.g., "latched") upon cessation of the pulse of power. The plunger detent position is illustrated in FIG. 2. In particular, in a one magnet-in-plunger embodiment such as that illustrated in FIG. 1-FIG. 5, first flux conductor 28-1 is situated whereby, when a ferromagnetic end 60 of plunger is aligned with first flux conductor 28-1 in the plunger first detent position, no net axial force is applied to the plunger assembly 26 due to first flux conductor 28-1. This is because the flux at the first axial position, e.g., at the first flux conductor 28-1, is all radial with no axial component. Moreover, the second axial position, i.e., the position of second flux conductor 28-2, is located relative to the first axial position so that, when the plunger assembly 26 is in the plunger first detent position, the plunger magnet 34 and second flux conductor 28-2 electromagnetically maintain axial alignment.

At its distal end the plunger shank 40 can assume the function and shape of a clevis, for example. Plunger shank 40 is configured to extend beyond the second axial position relative to solenoid frame 21 when the plunger assembly 26 has moved in a first translation direction to the plunger detent position of FIG. 2. The first translation direction is a direction from left to right in FIG. 1, e.g., from the plunger-retracted position of FIG. 1 to the plunger detent position of FIG. 2.

Spaced away from ferromagnetic end 60 the plunger shank 40 carries a ring-shaped plunger stop member 62. The plunger stop member 62 is preferably formed from a non-metallic material such as plastic, for example. Retaining ring 64 (e.g., an E-ring or the like) is provided on plunger shank 40 to secure plunger stop member 62 to plunger shank 40. The plunger stop member 62 is sized and configured to limit an extent of travel of the plunger assembly in a second translation direction opposite to the first translation direction. That is, when the plunger assembly 26 moves in the second translation direction depicted by arrow 66 in FIG. 2, the plunger stop member 62 abuts against solenoid frame 21. Retaining ring 64 prevents plunger stop member 62 from sliding during the impact that occurs when plunger assembly 26 goes from the plunger detent position shown in FIG. 2 to the plunger-retracted position shown in FIG. 1.

In particular, upon reaching the plunger-retracted position shown in FIG. 1 plunger stop member 62 abuts against an acoustic dampening assembly comprising one or more acoustic dampening members 68 which comprise solenoid frame 21. As shown in FIG. 1 and FIG. 2, the acoustic dampening assembly comprises two axially-aligned felt washers 68-1 and 68-2. The felt washers 68-1 and 68-2 are situated at the first axial end of solenoid frame 21, and are intermediate first flux conductor 28-1 and plunger stop member 62 when the plunger assembly 26 is in the plunger-retracted position shown in FIG. 1. The plunger stop member 62 can be held in position on plunger shank 40 by a retaining ring 70 or the like.

Thus, solenoid frame 21 comprises an acoustic dampening assembly/member situated to muffle impact of plunger stop member 62 with the solenoid frame 21 when the plunger assembly 26 has reached its limit of travel in the second translation direction.

In an example implementation shown in FIG. 1-FIG. 5, with respect to the plunger axis 32 the ferromagnetic edges of the plunger magnet 34 are equidistant from respective ferromagnetic edges of the second flux conductor 28-2 when the plunger assembly is held in the plunger first detent position shown in FIG. 2 and FIG. 4. That is, as shown in more detail in FIG. 4, edge 72R of plunger magnet 34 is spaced a same distance from edge 74R of second flux conductor 28-2 as edge 72L of plunger magnet 34 is spaced from edge 74L of second flux conductor 28-2. For the particular embodiment shown in FIG. 4, edges 72R and 74R are in a same first axial plane and edges 72L and 74L are in a same second axial plane. The respective edges 72 and 74 need not necessarily be axially planar, since it is possible for one of plunger magnet 34 and second flux conductor 28-2 to be axially thicker than the other. The edges of plunger magnet 34 and second flux conductor 28-2 can be kept in the desired relationship when the center planes of both plunger magnet 34 and second flux conductor 28-2 passing perpendicularly to the axis are aligned when the plunger assembly 26 is in the plunger detent position. As such, an extent of the plunger magnet 34 along the plunger axis 32 and an extent of the second flux conductor 28-2 in a direction parallel to the plunger axis 32 are chosen to provide a predetermined holding force to maintain the plunger assembly 36 in the plunger first detent position of FIG. 2 and FIG. 4.

As indicated above, FIG. 3 shows example ferromagnetic components of the solenoid of FIG. 1 in the plunger-retracted position, while FIG. 4 shows the same components in the plunger detent position. Better seen in FIG. 3 and FIG. 4 than in respective FIG. 1 and FIG. 2, the plural flux conductors are spaced radially from the plunger assembly by respective air gaps. FIG. 4 shows a first ring-shaped air gap 80 which exists between first flux conductor 28-1 and ferromagnetic end 60 of plunger first ferromagnetic member 36 when plunger assembly 26 is in its plunger detent position. FIG. 3 shows a second ring-shaped air gap 82 which exists between second flux conductor 28-2 and plunger assembly 26 (and thus which exists between second flux conductor 28-2 and plunger magnet 34 when the plunger assembly 26 is in its plunger detent position). FIG. 3 also shows a third ring-shaped air gap 84 which exists between third flux conductor 28-3 and plunger assembly 26. Thus, these gaps 80, 82, and 84 are the radial clearance between the plunger and stator. Therefore, in the embodiment of FIG. 1-FIG. 1 the solenoid stator comprises two coils (e.g., first coil 50-1 and second coil 50-2) in a common case (e.g., in solenoid frame case 22). Three ring air gaps are provided: first air-gap 80 at a first end (right end as shown in FIG. 1) of solenoid frame 21; third air-gap 84 at a second end (left end as shown in FIG. 1) of solenoid frame 21; and second air gap 82 situated between the two coils (e.g., between first coil 50-1 and second coil 50-2).

As shown in FIG. 1 and FIG. 2, the only solenoid ferromagnetic material along the plunger axis 32 comprises the plunger assembly 26. That is, other than ferromagnetic portions of the plunger assembly 26, the solenoid has no ferromagnetic material along the plunger axis 32.

In operation, a pulse of power which causes electrical current to flow in the first coil 50-1 results in a force for translating the plunger assembly in a first translation direction toward the plunger detent position of FIG. 2. A pulse of power which causes electrical current to flow in second coil 50-2 results in a force for translating the plunger assembly in a second translation direction away from the plunger first detent position (as depicted by arrow 66 in FIG. 2).

The plunger assembly 26 can comprise two steel rods which respectively form plunger first ferromagnetic member 36 and plunger second ferromagnetic member 38. Magnet 34 is provided in the middle between the steel rods of plunger first ferromagnetic member 36 and plunger second ferromagnetic member 38. The magnet 34 creates a flux which crosses the coil(s), such that when power is applied to first coil 50-1, it produces a force on the ferromagnetic portions of plunger assembly 26. At the same time, this flux, which (in the manner depicted in FIG. 5) circulates through the two washers (e.g., first flux conductor 28-1 and second flux conductor 28-2) and the case (e.g., 22) and plunger assembly 26, causes a force to be developed between the end of the steel rod (e.g., plunger first ferromagnetic member 36) and the washer (e.g., first flux conductor 28-1) at the end of the unit. The flux path as shown in FIG. 5 includes the solenoid frame 21 (e.g., the case), a flux conductor 28 (such as second flux conductor 28-2), a first ring air gap (e.g., air gap 82), plunger assembly 26, another ring air gap (e.g., air gap 80), another flux conductor 28 (e.g., first flux conductor 28-1), and back to the case/frame 21.

As shown in FIG. 5, flux lines cross from 34, across first coil 50-1 and second coil 50-2, to solenoid case 22. The flux across a coil and the current through that coil generates a force. Since the flux is crossing both first coil 50-1 and second coil 50-2, the only coil that generates force is the one that has current in it, e.g., Force(F)=Flux Density (B)×Current (I). In the situation shown in FIG. 1 and FIG. 5, since the flux density in the radial direction (with respect to plunger axis 32) and current is in the z-direction (into and out of the plane of the figure), then the force is in the axial direction (e.g., parallel to plunger axis 32). Thus, when the power is applied in a first direction to first coil 50-1, the plunger assembly 26 experiences a force which moves plunger assembly 26 to the plunger detent position shown in FIG. 2, e.g., a force to the right along plunger axis 32.

When the end of the steel rod, e.g., when ferromagnetic end 60 of plunger assembly 26 reaches the end of first flux conductor 28-1, the force at the first axial position drops to zero. Simultaneously, the magnet 34 straddles the center washer (e.g., second flux conductor 28-2) and finds a preferred magnetic position wherein ferromagnetic edges of the plunger magnet 34 are equidistant from respective ferromagnetic edges of second flux conductor 28-2. When electrical power is removed, that there is a magnetic "preference" for the plunger assembly 26 to stay in the position shown in FIG. 2, e.g., with plunger magnet 34 straddling second flux conductor 28-2, thereby creating a magnetic detent. Deviation from this preferred position causes the plunger magnet 34 to want to re-center itself Because the latch force is zero at equilibrium and increases as position is deviated from the zero position, it is call a "soft latch". At equilibrium, the axial center of plunger magnet 34 is aligned with the axial center of the washer of second flux conductor 28-2. When plunger magnet 34 is in position shown in FIG. 2, the forces are equal and opposite so there is no net force. If plunger magnet 34 is moved to one side, that side will have more force and will pull the magnet back to where the forces are equal.

When the opposite coil is energized (e.g., when second coil 50-2 is energized), the same action happens, except that plunger magnet 34 is pulled from the latch position toward the direction of arrow 66 in FIG. 2 and the steel rod comprising plunger first ferromagnetic member 36 is attracted to third flux conductor 28-3 (e.g., to the opposite end washer). In other words, if the current or the magnetic flux direction is reversed, then force direction will be reversed and will be parallel to arrow 66 in FIG. 2.

In an example implementation of a two-coil assembly embodiment such as that shown in FIG. 1-FIG. 5, the solenoid frame 21 can be oriented whereby gravitational force also attracts the plunger assembly 26 for translating the plunger assembly in the second translation direction (e.g., in the direction of arrow 66 of FIG. 2) away from the plunger first detent position. That is, when the solenoid frame 21 is situated vertically with its shank end being elevated, second coil 50-2 is assisted by gravity and thus need not be as large (e.g., need not extend as far in the axial direction) as first coil 50-1. In other words, once the plunger magnet 34 is pulled from the latched position of FIG. 2, plunger assembly 26 is allowed to fall due to gravity. There is a small amount of force generated from the permanent magnet flux that crosses second coil 50-2. The amount of power going in to second coil 50-2 is greater than the amount in first coil 50-1 so the force per watt of each coil is different. In view of being supplemented with gravitational force, in such implementation the second coil 50-2 is configured to generate less force on the plunger assembly 26 than first coil 50-1.

In view of features evident from the foregoing as well as elsewhere described, embodiments herein described thus concern solenoids having one or more of soft latches, bidirectionality, and quietness.

The latching is provided by the fact that, e.g., one or more flux conductors 28 are positioned to form a flux circuit (the flux circuit comprises the solenoid frame, the plunger assembly, and the at least one flux conductor). The flux circuit is arranged and configured so that the plunger assembly 26 is held in a plunger detent position (such as that shown in FIG. 2) upon cessation of the pulse of power.

Advantageously, elements comprising ferromagnetic metallic material (plunger ferromagnetic portion(s) and the flux conductor 28) which experience translation relative to one another during linear translation of plunger assembly 26 are arranged and configured so as not to make contact with one another even upon cessation of the linear translation of the plunger.

The embodiments also have bidirectional capability in that plunger assembly 26 can also linearly translate in a second direction along the plunger axis 32 upon application of a second pulse of power to the coil assembly, the second direction being opposite the first direction.

Considerable latitude can exist with respect to configuration and fashioning of various constituent elements of the solenoids described herein, some of which depend on factors related to manufacturing and/or environment of use. For example, rather than the intermediate second flux conductor 28-2 being formed from a solid ring-shaped ferromagnetic piece, the solid piece can be cut into two half pieces with the half pieces inserted on the frame bobbin 21. A two half-piece attachment of second flux conductor 28-2 may be particularly helpful when the bobbin of frame 21 is already tooled and has end flanges. As another example, one or more members 68 may comprise the acoustic dampening assembly, depending on the desired thickness of the acoustic dampening. As yet another example, the plunger magnet 34 can be either of smaller diameter or of same size as the remainder of plunger assembly 26. To obtain the strongest detent force, the largest possible diameter magnet is desired, but may have a side effect of needing more power to pull it from the detent.

In other example implementations the coil assembly 24 can comprise a single coil. In such implementations, a pulse of power which causes electrical current to flow in a first direction in the single coil results in a force for translating the plunger assembly in a first translation direction toward the plunger first detent position. On the other hand, a pulse of power which causes electrical current to flow in a second direction in the single coil results in a force for translating the plunger assembly in a second translation direction away from the plunger first detent position.

Various configurations can be provided for the solenoid frame 21. In one example implementation (such as that shown in the embodiment of FIG. 1-FIG. 5), in addition to its bobbin (about which the coils of coil assembly 24 are wound), solenoid frame 21 comprises a solenoid case 22. Solenoid frame case 22 has an essentially hollow cylindrical shape to at least partially define a coil cavity such as coil space 30. In such implementation the coil assembly 24 can be situated in the coil space/cavity 30 and configured at least partially to define a plunger cavity. The embodiment of FIG. 1-FIG. 5 has an illustrated implementation comprising a tubular frame with one "soft" latch position.

Figure 6:
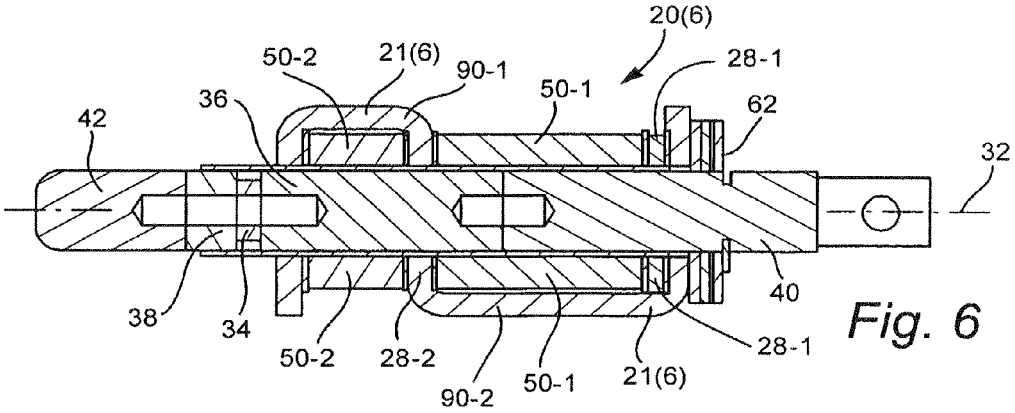
FIG. 6 is a cross sectioned view of a solenoid according to another example embodiment, showing the plunger in the plunger-retracted position.
Figure 7:
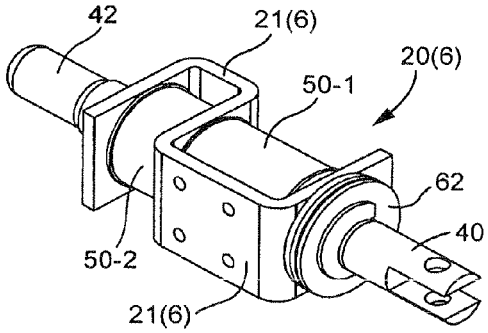
FIG. 7 is a perspective end view of the solenoid of FIG. 6.
Figure 8:
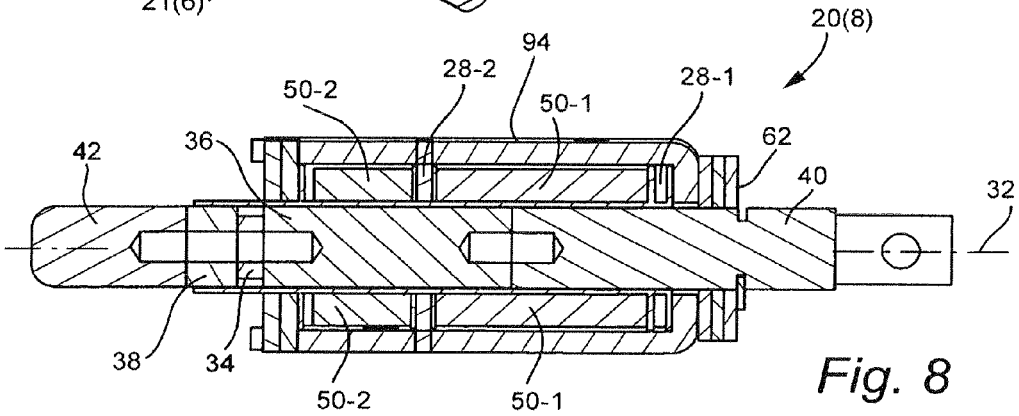
FIG. 8 is a cross sectioned view of a solenoid according to another example embodiment, showing the plunger in the plunger-retracted position.
Figure 9:
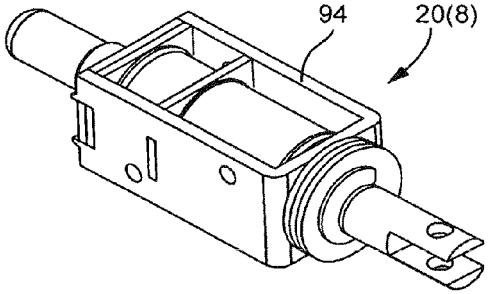
FIG. 9 is a perspective end view of the solenoid of FIG. 8.

Other solenoid structures are described with reference to other figures in which comparable elements have similar reference numerals. For example, FIG. 6 and FIG. 7 show an example solenoid embodiment wherein the solenoid frame/stator 21(6) comprises a substantially S-shaped member comprising a first frame segment 90-1 situated substantially on a first side of the plunger axis 32 and a second frame segment 90-2 situated substantially on a second side of the plunger axis 32. The embodiment of FIG. 6 and FIG. 7 is thus an open frame version, using a one piece ("S"-shaped) frame to complete the magnetic path. FIG. 8 and FIG. 9 show an example solenoid embodiment wherein the solenoid frame comprises box frame element 94 having at least one open side through which the exterior of, e.g., first coil 50-1 and second coil 50-2 are visible or otherwise exposed.

With their detenting capability, the embodiments of solenoids described herein can operate somewhat analogously to a step motor (e.g., stepper motor). That is, much in the same way a step motor takes one step (rotationally) and detents, the previously described embodiments can take one step (linearly) and detent. In the previously described embodiments, there is only one latch position selected especially for the application.

Figure 10:
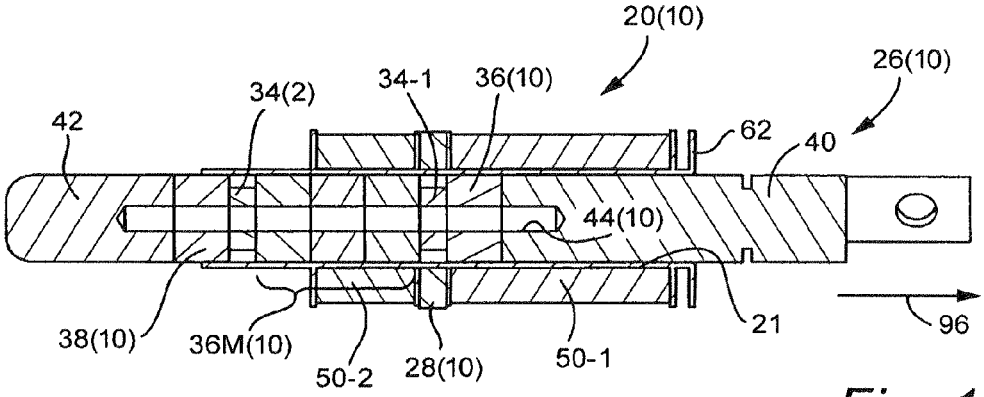
FIG. 10 is a cross sectioned view of a solenoid according to another example embodiment, showing the plunger in the plunger-retracted position.
Figure 11:
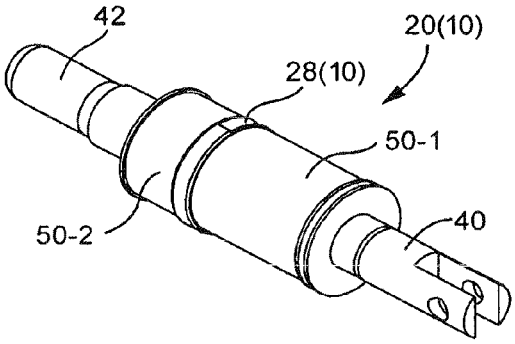
FIG. 11 is a perspective end view of the solenoid of FIG. 10.

In some example embodiments of solenoids (such as that illustrated by way of example with reference to FIG. 1-FIG. 5), the plunger assembly comprises one magnet. On the other hand, FIG. 10 and FIG. 11 illustrate an example embodiment of a solenoid 20(10) embodiment wherein plunger assembly 26(10) comprises two magnets, e.g., plunger magnet 34-1 and plunger magnet 34-2. In some example embodiments, provision of two magnets facilitates double latching, e.g., the ability to detent at two separate axial positions along plunger axis 32.

In the example embodiment of FIG. 10-FIG. 11, plunger assembly 26(10) [which functions as the center armature] comprises plunger shank 40; plunger first ferromagnetic member 36(10); plunger magnet 34-1; plunger intermediate ferromagnetic member(s) 36M(10); plunger magnet 34-2; plunger second ferromagnetic member 38(10); and plunger nose member 42, all aligned along plunger axis 32, and in the order just mentioned from right to left. A plunger dowel 44(10) joins all the members of plunger assembly 26(10). Having two plunger magnets, the plunger assembly 26(10) is structure to soft latch in two distinct positions.

The solenoid 20(10) of FIG. 10 and FIG. 11 has only one flux conductor, e.g., flux conductor 28(10), which is situated on the bobbin of frame 21 between first coil 50-1 and second coil 50-2. Thus, the solenoid 20(10) comprises two magnets on its plunger assembly 26 but only one steel washer (e.g., only one flux conductor 28(10)) between the two coils. When one coil (e.g., second coil 50-2) is energized, the energization pulls plunger assembly 26(10) through to the point where the plunger magnet 34-1 aligns with the center washer, e.g., aligns with flux conductor 28(10). After power ceases, the plunger assembly 26(10) is held in the plunger first detent position shown in FIG. 10. Subsequent energization of first coil 50-1 causes plunger assembly 26 to unlatch from the plunger first detent position shown in FIG. 10. The force caused by energization of first coil 50-1 causes plunger assembly 26 to move in the direction of arrow 96 whereby plunger magnet 34-2 becomes aligned with flux conductor 28(10) in a plunger second detent position. With a magnet generating flux that crosses a coil, there can be a push or a pull depending on the coil current direction. So while it is more powerful to pull the plunger assembly into the coil, it is also possible to push the plunger assembly away from the coil. This principle is applicable to other embodiments as well.

Figure 12:
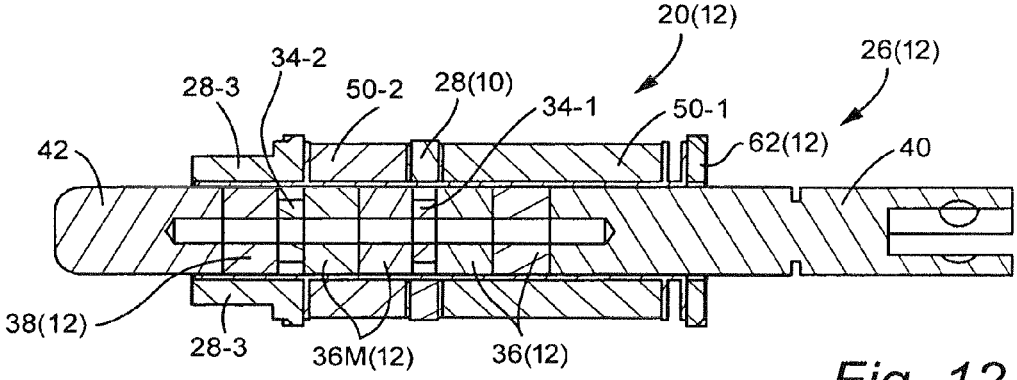
FIG. 12 is a cross sectioned view of a solenoid according to another example embodiment, showing the plunger in the plunger-retracted position.
Figure 13:
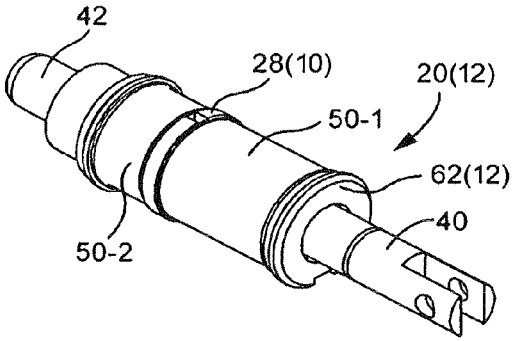
FIG. 13 is a perspective end view of the solenoid of FIG. 12.

The solenoid 20(12) of FIG. 12 and FIG. 13 resembles the solenoid 20(10) of FIG. 10 and FIG. 11, but has a thicker plunger stop member 62(12). The thicker plunger stop member 62(12) can be provided by two axially arranged plunger stop members 62. The thicker plunger stop member 62(12) tends to increase efficiency. There are two magnetic forces, the kind from the flux density and current and also the kind from two ferromagnetic members being attracted to each other. With the stop members , the plunger has something to be attracted to, and therefore will produce a higher force.

The solenoid 20(10) of FIG. 10 and FIG. 11 and the solenoid 20(12) of FIG. 12 and FIG. 13 thus advantageously provide "double latching", e.g., having the ability to latch at both ends. Other embodiments comprise triple or other multiple latching solenoids, e.g., solenoids having multiple steps with multiple latch positions. As such, some embodiments can function as a linear step motor.

In many of the solenoid embodiments provided above, the magnet comprising the solenoid is located or situated in-line with/within plunger assembly 26. In yet other example embodiments, the at least one flux conductor comprises a magnet which is not located in the plunger assembly. A magnet can be considered as a flux generator, but is also a flux conductor in the sense that flux is conducted through the magnet. In certain embodiments hereinafter, the solenoids comprise a solenoid frame; a coil assembly fixedly situated with respect to the solenoid frame; a plunger assembly configured to linearly translate in a first direction along a plunger axis upon application of a pulse of power to the coil assembly; at least one flux conductor comprising a magnet positioned radially exteriorly to the plunger assembly and at least one non-magnet flux conductor positioned radially exteriorly to the plunger assembly; wherein the flux conductors are arranged and configured so that the plunger assembly is held in a plunger detent position upon cessation of the pulse of power.

Figure 15:
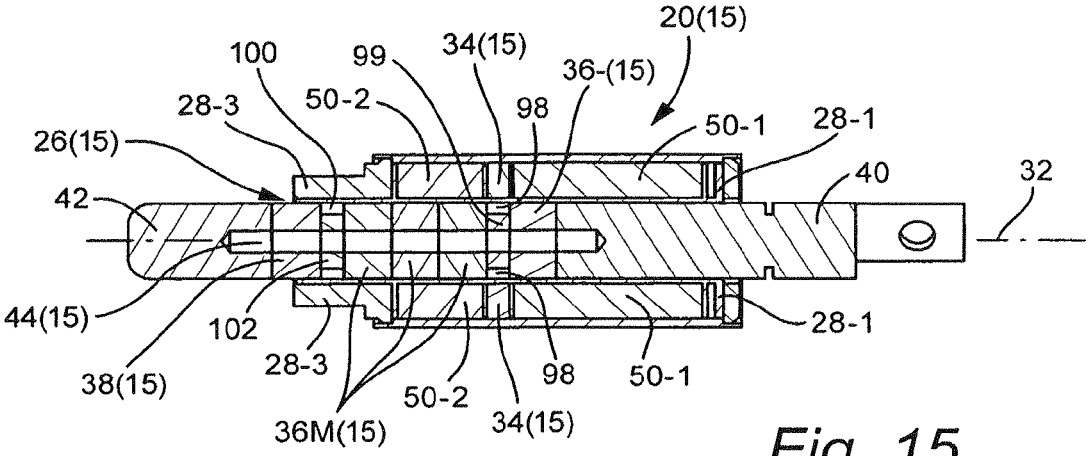
FIG. 15 is a cross sectioned view of a solenoid according to another example embodiment, showing the plunger in the plunger-retracted position.

For example, in the example solenoid embodiment of FIG. 15, magnet 34(15) is located in second axial position relative to solenoid frame 21, e.g., in the position occupied by second flux conductor 28-2 of the example embodiment of FIG. 1-FIG. 5. The solenoid 20(15) still has first flux conductor 28-1 located at the first axial position (near the shank end of solenoid frame 21) and the third flux conductor 28-3 located at the third axial position (the end of solenoid frame 21 which is opposite the shank end), but at the intermediate or second axial position the flux conductor takes the form of magnet 34(15). In other words, in the solenoid 20(15) the magnet 34(15) is situated peripherally exterior to plunger assembly 26(15) and intermediate coils of coil assembly 24, rather than being intermediate ferromagnetic components of plunger assembly 26(15).

The magnet 34(15) is preferably a ring-shaped magnet that is magnetized radially (e.g., magnetized so that lines of flux are in the direction of the radius of plunger assembly 26(15)). However, in an alternate implementation the magnet 34(15) could instead be axially magnetized magnet, if it is supplemented by two ferromagnetic washers. When the electric coil is powered, that the flux it generates must either aid or subtract from the permanent magnet.

The plunger assembly 26(15) of the example embodiment of FIG. 15 comprises plunger shank 40 and plunger nose member 42, with various ferromagnetic sections formed between plunger shank 40 and plunger nose member 42 and skewered on dowel 44(15). The ferromagnetic sections of plunger assembly 26(15) comprise plunger first ferromagnetic member(s) 36(15), plunger second ferromagnetic member 38(15), and various other intermediate ferromagnetic sections including two reduced diameter plunger sections or portions hereinafter described. The reduced diameter plunger sections are necessary because, in order to accomplish the latching, the radius of plunger assembly 26 cannot be uniform. Accordingly, FIG. 15 shows a first radial notch or groove 98 provided on the periphery of plunger assembly 26. In other words, the plunger assembly 26(15) has first reduced diameter plunger portion 99 which, when the plunger assembly 26(15) is in the plunger detent position of FIG. 15, is aligned with magnet 34(15). To provide a second latching position, plunger assembly 26(15) is similarly provided with a second radial notch or groove 100 at a location whereat plunger assembly 26(15) has another or second reduced diameter plunger portion 102.

Thus, in the example embodiment of FIG. 15, a similar soft latch is accomplished by replacing the second flux conductor 28-2 of other example embodiments (e.g., a washer that in other embodiments is between first coil 50-1 and second coil 50-2) with a ring magnet 34(15). The steel rod forming plunger assembly 26(15) is notched with grooves (e.g., grooves 98 and 100) that are the same width as the magnet thickness (in the direction of plunger axis 32). The plunger assembly 26(15) of the FIG. 15 embodiment soft latches when a groove of plunger assembly 26(15) is centered over the magnet 34(15). The grooves 98 and 100 are of the same width (with respect to plunger axis 32) as the thickness of magnet 34(15).

Figure 16:
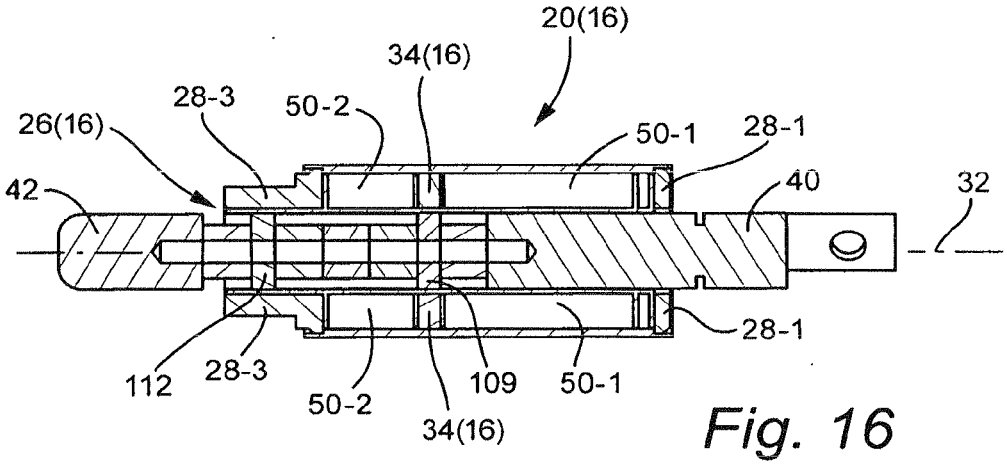
FIG. 16 is a cross sectioned view of a solenoid according to another example embodiment, showing the plunger in the plunger-retracted position.

FIG. 16 shows solenoid 20(16) which, like solenoid 20(15) of the example embodiment of FIG. 15, has an in-frame or coil-aligned magnet rather than an in-plunger magnet. Like the embodiment of FIG. 15, solenoid 20(16) has its magnet 34(16) aligned between first coil 50-1 and second coil 50-2. A primary difference between the solenoid 20(15) of FIG. 15 and the solenoid 20(16) of FIG. 16 is that the plunger assembly 26(16) FIG. 16 is essentially an inverse of the plunger assembly 26(15) of FIG. 15 with respect to plunger radius. In other words, whereas the majority of plunger assembly 26(15) is of a larger diameter and the latching sections (e.g., sections 99 and 100) are of a reduced diameter, the opposite occurs for the plunger assembly 26(16) of FIG. 16. That is, for the solenoid 20(16) of FIG. 16 the non-uniformity of plunger radius is accomplished by having two larger diameter sections 109 and 112 be the sections which latch with magnet 34(16), and the remainder of plunger assembly 26(16) being of smaller diameter than plunger latching sections 109 and 112. In the FIG. 16 embodiment, the edges are close to the washer but on the inside of the washer. On the other embodiments, the edges (which are the transitions between inner [smaller] and outer [larger] diameters of the plunger) are on the outside of washer 35.

Figure 17:
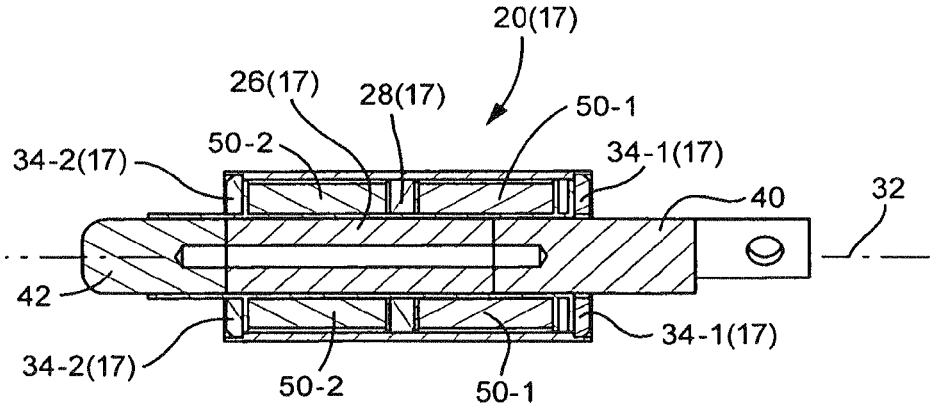
FIG. 17 is a cross sectioned view of a solenoid according to another example embodiment, showing the plunger in the plunger-retracted position.

FIG. 17 shows another example embodiment in which the at least one flux conductor comprises a magnet which is not located in the plunger assembly. Whereas in the embodiments of FIG. 15 and FIG. 16 the flux conductor takes the form of a magnet positioned in the second axial or intermediate position of the solenoid frame, the solenoid 20(17) of the embodiment of FIG. 17 replaces both first flux conductor 28-1 and third flux conductor 28-3 of previous embodiments with respective magnets 34-1(17) and 34-2(17). The second flux conductor 28-2 of the solenoid 20(17) remains situated in the second axial position, e.g., between first coil 50-1 and second coil 50-2. In other words, for the solenoid 20(17) the at least one flux conductor comprises two magnets 34-1(17) and 34-2 (17) which are positioned radially exteriorly to the plunger assembly 26(17) at respective two ends of the solenoid frame, and the non-magnet flux conductor (flux conductor 28-2) is positioned between the two magnets 34-1(17) and 34-2(17) with respect to a direction parallel to an axis 32 of the plunger assembly.

Thus, solenoid 20(17) is an extension of the two previous example embodiments in that it has magnets 34-1(17) and 34-2(17) situated on the extremes of the coil assembly (and a steel washer [second flux conductor 28-2] situated in between the two coils [e.g., between first coil 50-1 and second coil 50-2]). In the solenoid 20(17), ferromagnetic ends of the plunger assembly 26(17) line up with the edges of the magnets and will act like a detent. In the FIG. 17 embodiment, the coil spaces (and thus first coil 50-1 and second coil 50-2) are equal to show that there can be any division of coil space, depending on what is best suited for the application.

In some of the example embodiments previously described, a two-coil assembly is implemented by having a first coil (e.g., first coil 50-1) and a second coil (second coil 50-2) which are aligned in a direction parallel to the plunger axis 32. In such implementation, the second flux conductor (e.g., second flux conductor 28-2) can be positioned, e.g., between the first coil (e.g., first coil 50-1) and the second coil (e.g., second coil 50-2) with respect to a direction that is parallel to the plunger axis 32. In the implementation of a two-coil assembly embodiment shown in FIG. 14, on the other hand, the coil assembly 24(14) comprises a first coil (e.g., 50-1(14)) and a second coil (e.g., 50-2(14)) which are concentrically radially arranged with respect to the plunger axis 32.

Figure 14:
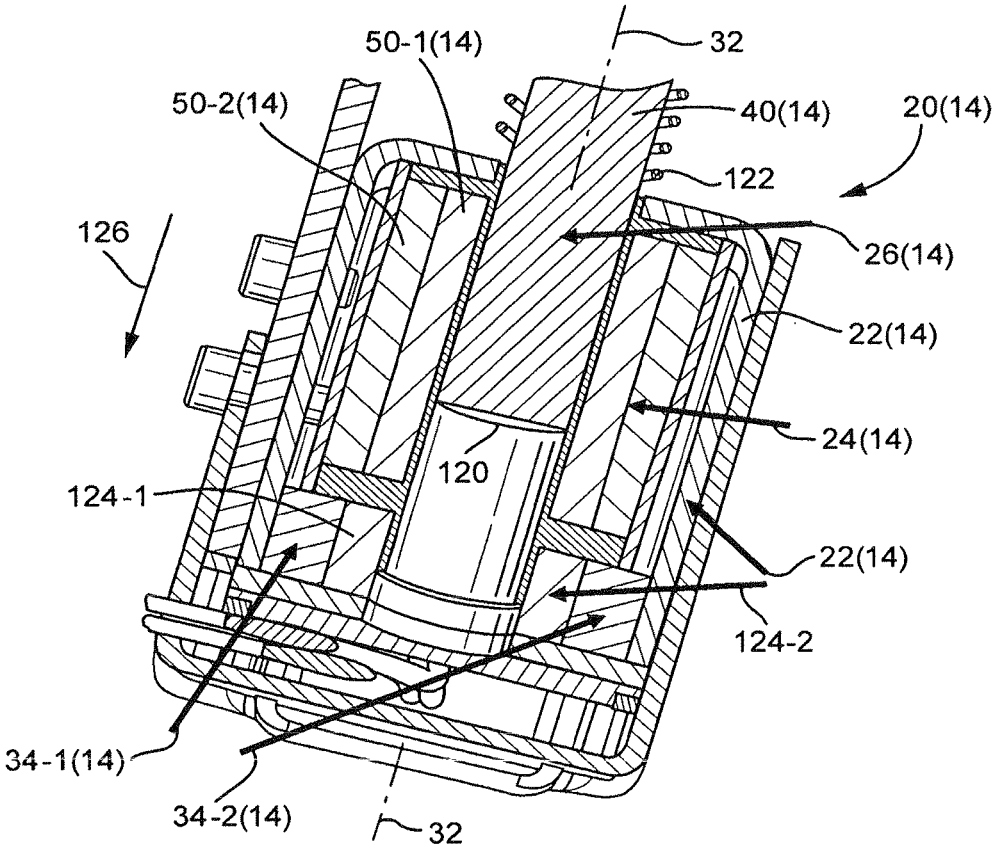
FIG. 14 is a cross sectioned view of a solenoid according to another example embodiment, showing the plunger in the plunger-retracted position.
Figure 14A:
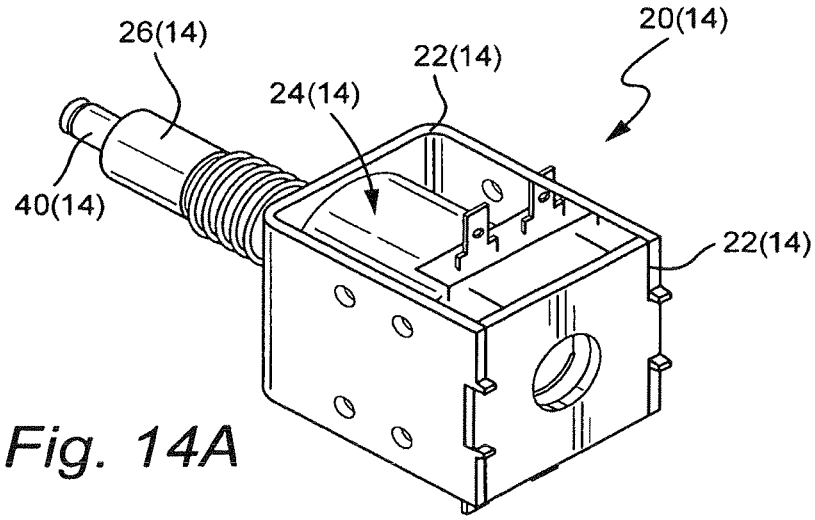
FIG. 14A is a side perspective view of the solenoid of FIG. 14.
Figure 14B:
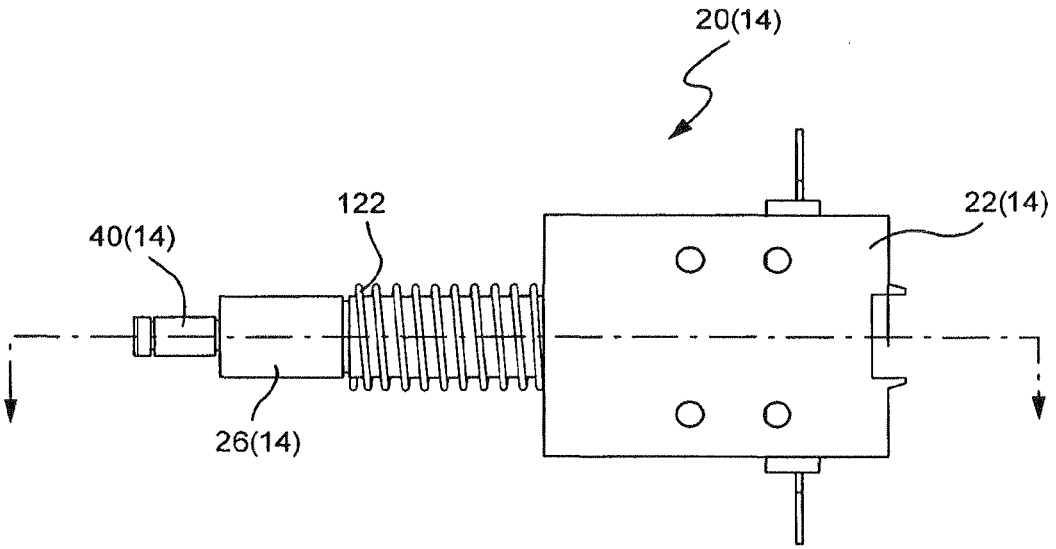
FIG. 14B is a top view of the solenoid of FIG. 14.

FIG. 14 shows an example embodiment of a solenoid 20(14) in a plunger-retracted position. The solenoid 20(14) comprises solenoid frame 21(14); coil assembly 24(14); plunger assembly 26(14); and flux conductors in the form of magnets 34-1(14) and 34-2(14). As understood subsequently with reference to other example embodiments, the solenoid frame 21 can be of various shapes and configurations. In the example embodiment of FIG. 1-FIG. 5, solenoid frame 21(14) comprises a bobbin which has an essentially hollow cylindrical shape and about which the coil assembly 24(14) is wound. The solenoid frame 21(14) also comprises a box-like case which (as shown in FIG. 14A) is partially open (in a manner similar to FIG. 9).

The coil assembly 24(14) is fixedly situated with respect to solenoid frame 21(14). In particular, two radially concentric coils of coil assembly 24 (e.g., first coil 50-1(14) and second coil 50-2(14)) of coil assembly 24 are wound about a circumferential surface(s) of the bobbin of solenoid frame 21(14), with the first coil 50-1(14) being wound beneath second coil 50-2(14). The two coils can be wound at the same time if each coil has the same number of turns.. The volume within solenoid frame 21(14), e.g., within the bobbin, occupied by coil assembly 24 in turn defines a plunger cavity which is essentially concentric to solenoid frame 21(14) and coil assembly 24(14).

Figure 14C:
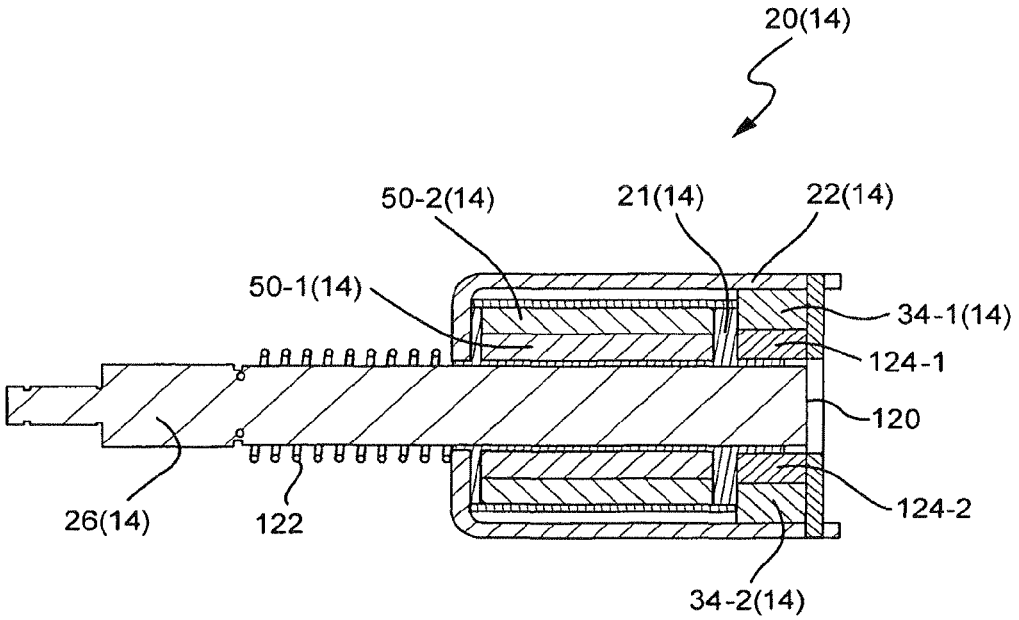
FIG. 14C is a sectioned view of FIG. 14B taken along line 14C-14C.

The plunger assembly 26(14) of FIG. 14 comprises, by way of example, a single ferromagnetic (e.g., steel) rod piston or plunger. The plunger assembly 26(14) has a ferromagnetic latching plunger end 120 and an opposite working or shank end 40(14). Proximate its shank end 40(14) a biasing spring 122 is wound around plunger assembly 26(14) to bias plunger assembly 26(14) to its plunger-extended position. The plunger-extended position is shown in FIG. 14. In the embodiment of FIG. 14, the plunger detent position is actually a plunger-retracted position, and is shown in FIG. 14C.

The solenoid frame case 22(14) of solenoid 20(14) is ferromagnetic (e.g., steel), and has an end whereat bar magnets 34-1(14) and 34-2(14) are attached to the walls of frame case 22(14). Positioned interiorly of bar magnets 34-1(14) and 34-2(14) are flux conductors 124-1 and 124-2 (which can be one piece), which essentially serve as flux concentrators for the respective magnets 34(14).

In operation, energization (e.g., a pulse of power applied to) one of the coils of coil assembly 24(14) creates a force which causes plunger assembly 26(14) to travel in the direction of arrow 126 in FIG. 14. When the lines of flux between latching plunger end 120 is essentially axially aligned with coil-farthest edges of the magnets 34-1(14) and 34-2(14) in the manner shown in FIG. 14C, the lines of flux are essentially all radial and the plunger assembly 26(14) is held in a detent position. If a pulse is applied to the other coil of coil assembly 24(14), the holding power of the detent position is undone, and the biasing force of spring 122 causes plunger assembly 26(14) to translate back to its plunger-extended position (in a direction opposite arrow 126 shown in FIG. 14).

While the embodiment of FIG. 14 shows two concentric coils in an embodiment in which the magnet(s) is/are not in the plunger assembly, it will be appreciated that in magnet-in-plunger embodiments such as various embodiments previously described that concentric coils can be used as an alternative to axially-aligned coils which are serially arranged along an axis.

It will be appreciated that the coil size of any given implementation represents how much stroke is powered. The actual detent position is determined, e.g., by the positioning of the coils and of the flux conductors.

The example embodiments described herein or encompassed hereby have many advantages and features. Example, non-limiting salient features include the fact that there is not direct metal-to-metal contact, and there is cushioning that makes the unit "quiet". Features from one of the foregoing embodiments can be combined or "cross-pollinated" with features of another embodiment. For example, the example embodiments of FIG. 15 through FIG. 17 can have differing configurations of frames or cases (such as described with respect to other illustrated embodiments). Moreover, any embodiment can be a vertical orientation embodiment (and thus having a "weaker" second coil) or an embodiment in which same strength coils are utilized.

Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A solenoid comprising:

a solenoid frame;

a coil assembly fixedly situated with respect to the solenoid frame;

a plunger assembly configured to linearly translate in a first direction along a plunger axis upon application of power to the coil assembly, with respect to the plunger axis the plunger assembly comprising a ferromagnetic latching plunger end;

at least one magnet;

wherein at least one magnet is positioned radially exteriorly to the plunger assembly, the at least one magnet being so located and configured whereby:

during application of power to the coil assembly translation occurs between the at least one magnet and the plunger assembly; and upon cessation of the power the at least one magnet and the plunger assembly acquire a positional relationship in a plunger holding position wherein the latching end of the plunger assembly is held in axial alignment along the plunger axis with the at least one magnet and the latching end of the plunger assembly is positioned radically interiorily of the at least one magnet.

2. The solenoid of claim 1, wherein the magnet is a permanent magnet.

3. The solenoid of claim 1, wherein upon acquiring the positional relationship in the plunger holding position no axial net force is applied to the plunger assembly.

4. The solenoid of claim 1, wherein the at least one magnet comprises a first magnet and a second magnet, and wherein the second magnet is axially spaced from the first magnet, and wherein:

upon the cessation of the power the first magnet and a first end of the ferromagnetic plunger portion acquire a first positional relationship to cause the plunger assembly to be held in a first plunger holding position; and upon the application of the power the second magnet and a second end of the ferromagnetic plunger portion acquire a second positional relationship to cause the plunger assembly to be held in a second plunger holding position.

5. The solenoid of claim 4, further comprising a non-magnet flux conductor positioned radially exteriorly to the plunger assembly, the non-magnet flux conductor being spaced apart from and between the first magnet and the second magnet in a direction parallel to the plunger axis.

6. The solenoid of claim 5, wherein the coil assembly comprises a first coil and a second coil, and wherein the non-magnetic flux conductor is located between the first coil and the second coil.

7. The solenoid of claim 1, further comprising means for biasing the plunger assembly in a plunger-extended position; wherein the coil assembly comprises a first coil and a second coil, and wherein:

as a result of application of a pulse of power to the first coil the plunger assembly travels from the plunger-extended position to the plunger holding position;

as a result of application of a pulse of power to the second coil, a biasing force of the biasing means causes the plunger assembly to translate from the plunger holding position to the plunger extended position.

8. The solenoid of claim 7, wherein in the plunger holding position lines of flux through the latching plunger end of the plunger assembly are essentially radially with the at least one magnet.

9. The solenoid of claim 8, wherein in the plunger holding position the lines of flux through the latching plunger end of the plunger assembly are essentially radially aligned with an end of the at least one magnet.

10. The solenoid of claim 7, wherein the first coil and the second coil are concentrically radially arranged with respect to the plunger axis.

11. The solenoid of claim 7, further comprising a case which at least partially encloses the coil assembly and the ferromagnetic plunger portion; wherein the plunger assembly further comprises a plunger shank end; and wherein the biasing means is wound around a portion of the plunger shank end that extends outside the case.

12. The solenoid of claim 1, wherein the coil assembly comprises a first coil and a second coil, both the first coil and the second coil being positioned radially exteriorly to the plunger assembly, and wherein the at least one magnet is positioned in an axial position between the first coil and the second coil.

13. The solenoid of claim 1, wherein the plunger assembly is configured to linearly translate in a second direction along the plunger axis upon application of a second pulse of power to the coil assembly, the second direction being opposite the first direction.

14. The solenoid of claim 1, wherein in linear translation along the plunger axis the latching plunger end does not experience axial contact.

15. The solenoid of claim 14, wherein in linear translation along the plunger axis the latching plunger end does not make metal-to-metal contact.

16. The solenoid of claim 1, further comprising at least one flux conductor, the at least one magnet and the at least one flux conductor both being aligned exteriorly to the plunger assembly and axially aligned along the plunger axis.

17. The solenoid of claim 16, wherein the at least one flux conductor is positioned radially exteriorly to the at least one magnet.

18. The solenoid of claim 1,wherein the latching plunger end is a terminal distal end of the plunger assembly.

19. The solenoid of claim 1, wherein the latching plunger end is configured to remain within the solenoid frame both during application of the power and upon cessation of the power.

* * * * *